US006641186B2

(12) United States Patent
Tsai

(10) Patent No.: US 6,641,186 B2
(45) Date of Patent: Nov. 4, 2003

(54) COMBINATION OF MOUNTING PLATE AND ROSE FOR DOOR LOCKS

(76) Inventor: Miao-Hsueh Tsai, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 10/056,338

(22) Filed: Jan. 28, 2002

(65) Prior Publication Data

US 2003/0141725 A1 Jul. 31, 2003

(51) Int. Cl.[7] ..... E05B 15/02

(52) U.S. Cl. ..... 292/357; 292/336.3; 292/DIG. 53; 292/DIG. 64; 70/450

(58) Field of Search ..... 292/357, 336.3, 292/DIG. 64, DIG. 53, 359, DIG. 60, 202, 203, 204, 207; 70/451, 452, 450; 16/412; 248/220.21; 411/338, 339; 403/279, 280, 282; 285/373

(56) References Cited

U.S. PATENT DOCUMENTS 5,445,423 A * 8/1995 Mader ..... 292/336.3
5,485,734 A * 1/1996 Yang ..... 70/285
5,505,508 A * 4/1996 Kuo ..... 292/169.17
5,636,882 A * 6/1997 Hook ..... 292/169.15
5,909,919 A * 6/1999 Wang ..... 292/359
5,922,003 A * 7/1999 Anctil et al. ..... 156/293
5,960,517 A * 10/1999 Sprekeler ..... 292/336.3
6,023,952 A * 2/2000 Mantarakis et al. ..... 70/99
6,357,807 B1 * 3/2002 Fan ..... 292/296

FOREIGN PATENT DOCUMENTS

GB 2344613 A * 6/2000 ..... E05D/5/10
WO WO 97/41323 * 11/1997

* cited by examiner

*Primary Examiner*—J. J. Swann
*Assistant Examiner*—Dinesh N Melwani
(74) *Attorney, Agent, or Firm*—Charles E. Baxley

(57) ABSTRACT

A door lock assembly includes a rose having a peripheral flange which has a recess defined therein. A handle is connected to an outer surface of said rose and a mounting plate is connected to said inner surface of said rose. A lock device is located between the rose and the mounting plate. Two retaining members extend from an inner surface of said rose and two engaging members extend from said mounting plate. The engaging members are force-fitted to said retaining members. The mounting plate has a groove defined therethrough so that the lock device is engaged with said groove and a latch is connected to said lock device and extends through said recess of said peripheral flange.

1 Claim, 3 Drawing Sheets

COMBINATION OF MOUNTING PLATE AND ROSE FOR DOOR LOCKS

FIELD OF THE INVENTION

The present invention relates to a door lock wherein the mounting plate has engaging members each with a slit defined therein and the rose has retaining members which are force-fitted into the engaging members to simplify the process of assembling.

BACKGROUND OF THE INVENTION

A conventional door lock generally includes a handle which is connected to a rose by bolts and a mounting plate is connected to the rose. A lock device is located and positioned between the rose and the mounting plate. The assembly including the mounting plate, the lock device and the rose is fixed to an inside or an outside of a door. The mounting plate and the rose generally are connected to each other by extending bolts through the mounting plate and engaged with engaging members with inner threaded recesses. The assembling processes of the mounting plate and the rose are time-consuming and the lock device has to be properly positioned during using the bolts to connect the mounting plate and rose.

The present invention intends to provide a door lock wherein the mounting plate and the rose is easily snapped to each other without using bolts.

SUMMARY OF THE INVENTION

In accordance with one aspect of he present invention, there is provided a door lock assembly which comprises a rose attached to the door and having a peripheral flange and a recess is defined in said peripheral flange. A handle is connected to an outer surface of said rose and a mounting plate is connected to said inner surface of said rose. Two retaining members extend from an inner surface of said rose and two engaging members extend from said mounting plate. The engaging members are force-fitted to said retaining members. A groove is defined through said mounting plate so as to allow a lock device position between the rose and the mounting plate to be engaged with the groove. The lock device has a bolt which extends from the recess of said peripheral flange of said rose.

The primary object of the present invention is to provide a door lock assembly wherein the rose and the mounting plate can be easily connected to each other by force-fitting the engaging members on the mounting plate into the tubes on the rose so as to simplify the assembling processes of the door lock assembly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
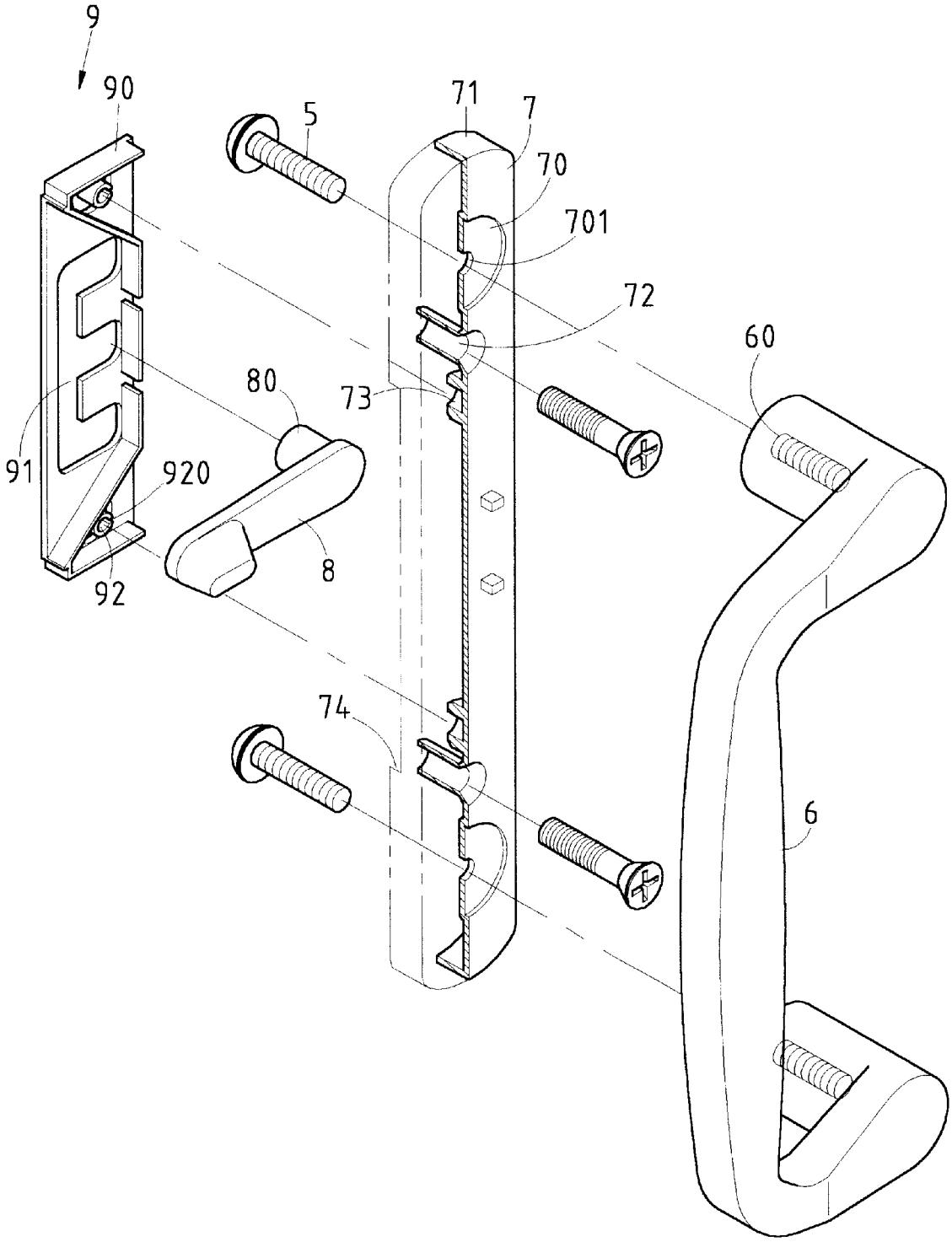
FIG. 1 is an exploded view to show the door lock assembly of the present invention.
Figure 2:
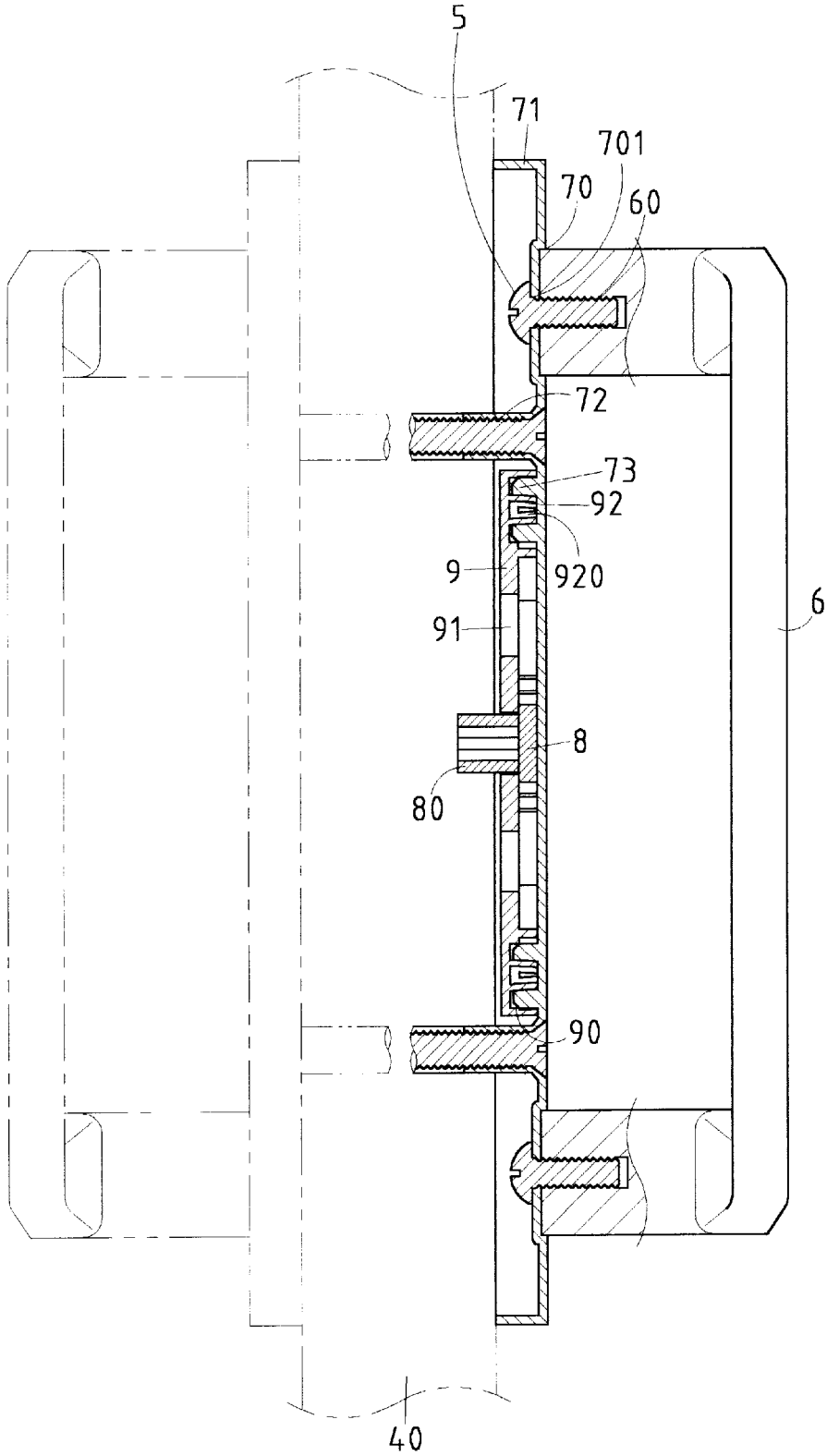
FIG. 2 is a cross sectional view to show the door lock assembly is connected to a door.

Referring to FIGS. 1 and 2, the door lock assembly of the present invention comprises a rose 7 having a peripheral flange 71 and a recess 74 defined in said peripheral flange 71. Two tubes 72 extend from an inner surface of said rose 7 and two bolts extend through said two tubes 72 and are engaged with a door 40. The peripheral flange 71 contacts against the door 40 and two recessed areas 70 are defined in an outer surface of the rose 7. A handle 6 has two threaded holes 60 defined therein and two bolts 5 extend through holes 701 in the recessed areas 70 of the rose 7 from the inner surface of said rose 7 and are engaged with said two threaded holes 60. The two ends of the handle 6 are engaged with the recessed areas 70. Two retaining members 73 extend from the inner surface of said rose 7.

A mounting plate 9 has a flange 90 and is connected to said inner surface of said rose 7. Two engaging members 92 such as tubes extend from said mounting plate 9 and each of the engaging members 92 has a longitudinal slit 920 defined therethrough so that the engaging members 92 can be expanded or narrowed easily. The retaining members 73 each have a receiving chamber which receives respective one of said two engaging members 92 when assembling the mounting plate 9 to the rose 7. In other words, when assembling the mounting plate 9 to the rose 7, said engaging members 92 can be easily and quickly force-fitted to said retaining members 73. A groove 91 is defined through said mounting plate 9 and includes three horizontal sections and a vertical section which communicates with said three horizontal sections.

Figure 3:
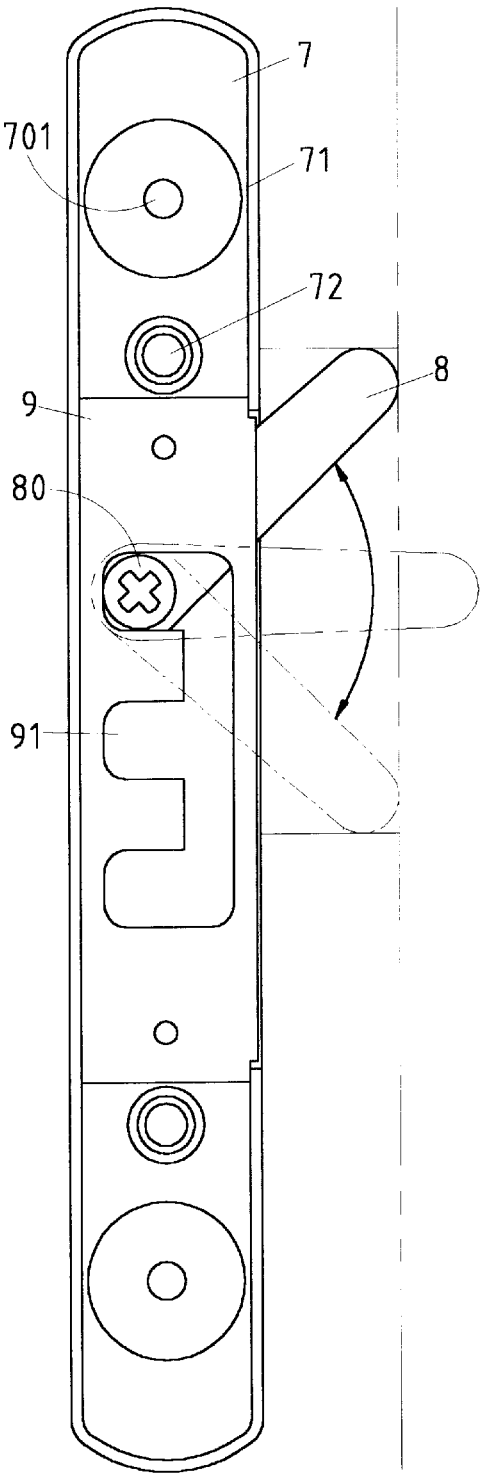
FIG. 3 shows the lock device is positioned in a higher horizontal section of the groove in the mounting plate.
Figure 4:
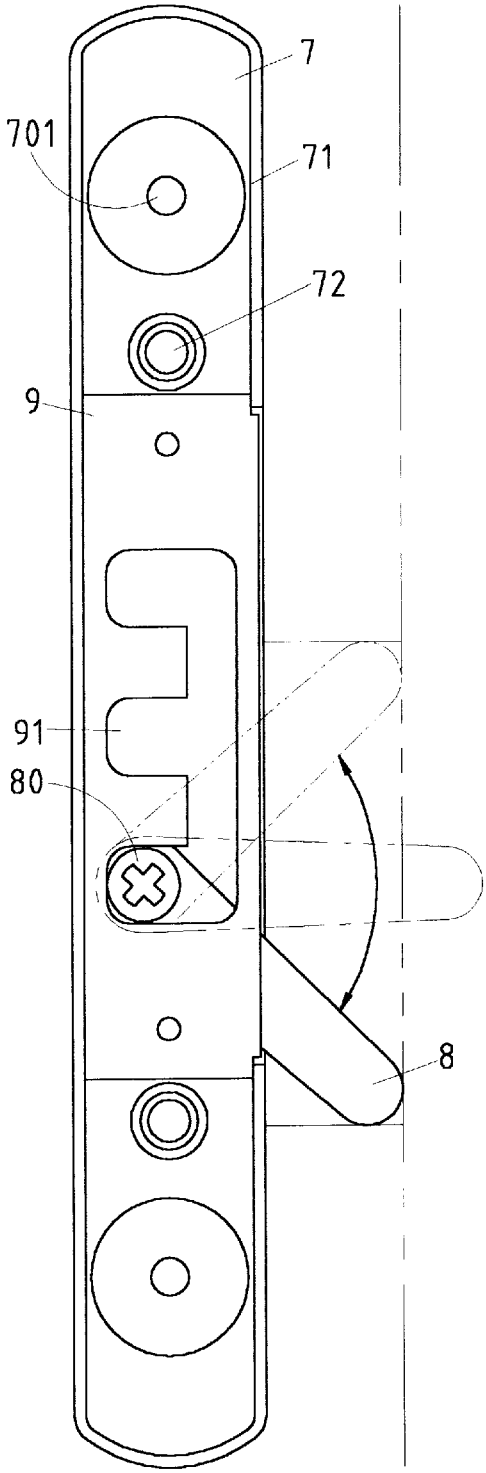
FIG. 4 shows the lock device is positioned in a lower horizontal section of the groove in the mounting plate.

Further referring to FIGS. 3 and 4, a lock device 80 is engaged with one of said three horizontal sections of said groove 91 and a latch 8 is connected to said lock device 80. The latch 8 extend through said recess 74 of said peripheral flange 71 of said rose 7 so that when the lock device 80 is rotated by a key (not shown), the latch 8 is rotated to be engaged with or removed from a bore in a frame (not shown). The positions of the lock device 80 can be set by engaging the lock device 80 with either one of the three horizontal sections.

While we have shown and described the embodiment in accordance with the present invention, it should be clear to those skilled in the art that further embodiments may be made without departing from the scope of the present invention.

What is claimed is:

1. A door lock assembly comprising:

a rose having a peripheral flange and a recess defined in said peripheral flange, a handle connected to an outer surface of said rose and two retaining members extending from an inner surface of said rose, said retaining members each having a receiving chamber, said rose adapted to be connected to a door;

a mounting plate connected to said inner surface of said rose and two engaging members extending from said mounting plate, said engaging members each having a longitudinal slit defined therethrough and being force-fitted to said receiving chambers of said retaining members, a groove defined through said mounting plate and including three horizontal sections and a vertical section which communicates with said three horizontal sections, and a lock device engaged with one of said three horizontal sections of said groove and a latch connected to said lock device, said latch extending through said recess of said peripheral flange of said rose.

* * * * *